US005489373A

United States Patent [19]

Parthasarathi

[11] Patent Number: 5,489,373

[45] Date of Patent: Feb. 6, 1996

[54] AQUEOUS ZINC SOLUTION RESISTANT TO PRECIPITATION

[75] Inventor: Arvind Parthasarathi, North Branford, Conn.

[73] Assignee: Olin Corporation, New Haven, Conn.

[21] Appl. No.: 382,693

[22] Filed: Feb. 2, 1995

[51] Int. Cl.[6] ..... C25D 5/48

[52] U.S. Cl. ..... 205/246; 205/155; 205/244; 205/245; 205/309

[58] Field of Search ..... 205/155, 244, 205/309; 148/246, 245

[56] References Cited

U.S. PATENT DOCUMENTS

| | | | |
|---|---|---|---|
| 3,764,400 | 10/1973 | Caule . | |
| 3,856,637 | 12/1974 | Kessler | 205/309 |
| 3,910,784 | 10/1975 | Rastas . | |
| 3,993,548 | 11/1976 | Creutz | 205/309 |
| 4,071,422 | 1/1978 | Charlton et al. . | |
| 4,387,006 | 6/1983 | Kajiwara et al. . | |
| 4,552,629 | 11/1985 | Duyvesteyn et al. . | |
| 4,647,315 | 3/1987 | Parthasarathi et al. . | |
| 5,022,968 | 6/1991 | Lin et al. . | |
| 5,071,520 | 12/1991 | Lin et al. . | |
| 5,098,796 | 3/1992 | Lin et al. . | |
| 5,230,932 | 7/1993 | Chen et al. . | |
| 5,250,363 | 10/1993 | Chen . | |
| 5,356,527 | 10/1994 | Chao et al. . | |

*Primary Examiner*—Sam Silverberg
*Attorney, Agent, or Firm*—Gregory S. Rosenblatt

[57] ABSTRACT

There is disclosed an aqueous chemical solution that consists essentially of zinc ions, a source of hydroxides, and silicon ions. The ratio of silicon to zinc (Si:Zn) is, by weight from about 1:5 to about 1:250. Within the ratio range, the silicon ions inhibit precipitation of zinc from the chemical solution. This is particularly useful when the chemical solution is an electrolyte for the deposition of zinc or a zinc containing compound onto a metallic structure where a critical zinc content must be maintained to impart adequate adhesion of a coated substrate to a polymer adhesive.

7 Claims, No Drawings

AQUEOUS ZINC SOLUTION RESISTANT TO PRECIPITATION

CROSS REFERENCE TO RELATED APPLICATION

This patent application relates to U.S. Pat. No. 5,098,796 entitled "Chromium-Zinc Anti-Tarnish Coating on Copper Foil" by Lifun Lin et al. that issued on Mar. 24, 1992 and which is incorporated by reference in its entirety herein.

BACKGROUND OF THE INVENTION

This invention relates to a zinc containing aqueous solution that resists zinc precipitation. More particularly, silicon is added to an alkaline, aqueous electrolyte that contains zinc ions in a specified zinc to silicon ratio.

Alkaline aqueous chemical solutions containing zinc are widely used such as for galvanizing steel and providing tarnish resistance to copper and copper alloys. One limitation with these alkaline solutions is that zinc continuously precipitates from the solution, both during use and while the solution is not in use.

To maintain the chemical solution in optimum operating condition, the solution must be filtered to remove precipitated zinc metal, frequently analyzed to determine the present zinc content and replenished to replace the precipitated zinc. These steps are time consuming and the chemical solution is out of service during the filtering, analyzing, replenishing sequence. U.S. Pat. No. 5,098,796 to Lin et al. discloses an electrolyte for codepositing a mixture of chromium and zinc on a metallic substrate that is an alkaline, aqueous zinc containing solution. The codeposited layer imparts the substrate with tarnish resistance at room temperature and at elevated temperatures, up to about 220° C. The codeposited layer also improves the adhesion of the substrate to a polymer adhesive or to a polymer molding resin.

The present inventor has now discovered that when the zinc content of this electrolyte drops below 0.8 grams per liter (g/l), adhesion of the anti-tarnish coating to a copper substrate is impaired.

Therefore, to eliminate lost time while the chemical solution is being filtered, analyzed and replenished and to maintain the enhanced adhesion of a codeposited layer of chromium and zinc, there is a need for an alkaline zinc containing electrolyte that resists zinc precipitation.

SUMMARY OF THE INVENTION

Accordingly, it is an object of the invention to provide an alkaline, aqueous chemical solution that contains zinc ions and inhibits zinc precipitation from the solution. It is a feature of the invention that the addition of silicon to the solution inhibits the precipitation of zinc. Yet another feature of the invention is that the solution may further contain water soluble hexavalent chromium ions for the electrodeposition of a codeposited layer of chromium and zinc.

Among the advantages of the invention is that by inhibiting zinc precipitation, the chemical solution is effective for longer periods of time without requiring zinc salt additions. Another advantage is that when the chemical solution is an electrolyte, more of the zinc is deposited onto a substrate. Yet another advantage of the invention is that by inhibiting precipitation of the zinc, a more accurate calculation of the bath chemistry is possible and it is easier for an operator to ensure that the zinc content remains above a critical minimum value.

In accordance with the invention, there is provided an aqueous chemical solution that consists essentially of from about 0.07 g/l to about 30 g/l of zinc ions, an amount of silicon ions effective to inhibit precipitation of the zinc and from about 3 g/l to about 150 g/l of a hydroxide source.

The electrolyte is prepared by supplying an aqueous solution having a pH in excess of 7. Dissolving silicon in that aqueous medium, from a water soluble silicon source, in an amount that provides a silicon ion content effective to inhibit precipitation of zinc from the electrolyte and then, subsequent to the addition of the silicon ions, dissolving from about 0.07 to about 30 grams per liter of zinc ions into the aqueous medium.

The above stated objects, features and advantages will become more apparent from the specification that follows.

DETAILED DESCRIPTION

The precipitation of zinc ions from an alkaline, aqueous solution is inhibited by the presence of a concentration of silicon ions effective to inhibit precipitation of the zinc ions. The most effective concentration of silicon ions is dependent on the zinc concentration. The ratio, by weight, of silicon to zinc (Si:Zn) is from about 1:250 to about 1:5 and more preferably, the ratio, by weight, is from about 1:10 to about 1:60.

When the silicon content is less than 1:250, the beneficial effect of the silicon is lost. When the silicon content exceeds 1:5, the integrity of the deposit obtained from the chemical solution is impacted. For example, when in an electrolytically codeposited layer of chromium and zinc, when the silicon content exceeds 1:5, the adhesion promoting properties of the codeposited layer are impaired.

Most preferably, the ratio, by weight of silicon to zinc in the chemical solution is from about 1:10 to about 1:20.

The silicon ions are provided from any suitable, water soluble silicon containing compound. A preferred group of compounds are the silicates such as sodium silicate or potassium silicate, as well as mixtures thereof. Other water soluble silicon containing groups of compounds such as silanes are also satisfactory.

The chemical solution is made alkaline by adding a suitable caustic or salt. Preferably, alkalinity is provided by a hydroxide source such as sodium hydroxide, potassium hydroxide or ammonium hydroxide. Most preferred is sodium hydroxide.

The zinc ions are supplied in the form of a soluble zinc compound. The zinc compound may be soluble in the caustic, such as zinc oxide (ZnO), or in the aqueous component of the solution. The concentration of zinc ions is from about 0.07 g/l to about 30 g/l and, preferably, from about 0.3 g/l to about 10 g/l.

The aqueous solution may be used for any desired purpose such as electrolytic or non-electrolytic coating or for anodization. In one preferred embodiment, the aqueous medium is utilized as an electrolyte for the deposition of zinc or a zinc containing compound onto a metallic substrate. Among the metals that may be combined with zinc in the electrolyte for codeposition are chromium, copper, nickel, aluminum, tin and iron, as well as mixtures thereof.

A zinc compound containing chromium is useful as an anti-tarnish coating on copper or copper alloy substrates, such as foils and leadframes.

Chromium ions, in the form of hexavalent chromium ions, are added to the electrolyte as a hexavalent chromium salt such as sodium dichromate ($Na_2Cr_2O_7.2H_2O$). Preferably, the chromium (VI) ions are present in an amount of from about 0.05 g/l to about 5 g/l and more preferably in an amount of from about 0.3 g/l to about 1 g/l.

When preparing an aqueous medium according to the invention., it is desirable to add the silicon to the bath prior to adding the zinc. This is because without the silicon addition, the zinc immediately begins to precipitate from the solution and it is difficult to accurately maintain a desired zinc content.

One method to produce the aqueous solution of the invention is to first supply an aqueous medium that has a pH in excess of 7 and preferably, in excess of 11. This aqueous medium may be prepared by adding to water, preferably deionized water, from about 3 to about 150 grams per liter of a hydroxide source such as sodium hydroxide or potassium hydroxide. The water is either at room temperature or heated above room temperature during addition of the hydroxide source.

The silicon ions are then added to the aqueous medium by adding a suitable amount of a silicate such as sodium silicate to achieve the desired silicon to zinc (Si:Zn) ratio, by weight, of between about 1:250 and about 1:5. If the aqueous medium is to contain metal ions other than zinc, they are also added at this time.

Finally, the necessary amount of a soluble zinc salt is added to the bath to a zinc ion content of from about 0.07 to about 30 grams per liter.

The advantages of the alkaline, aqueous medium of the invention will become more apparent from the examples that follow.

EXAMPLES

An aqueous electrolyte containing 14.4 g/l sodium hydroxide, 1 g/l zinc ions and 0.5 g/l chromium (VI) ions was prepared and had a pH of 13.4. This electrolyte was heated to a temperature of 60° C. and became part of an electrolytic cell having stainless steel anodes and a copper alloy C194 (composition by weight: 2.1–2.6% iron, 0.05–0.20% zinc, 0.015–0.15% phosphorous and the balance copper) substrate as the cathode. A current density of 10 milliamps/centimeter$^2$ (mA/cm$^2$) was impressed across the electrolytic cell for a time of 10 seconds.

A codeposited layer of chromium and zinc was deposited on the copper alloy C194 substrate. This codeposited layer had strong adhesion to the substrate as determined by a tape test. A piece of SCOTCH TYPE 600 tape (3M Corporation, Minneapolis, Minn.) having a length of at least 5.1 centimeters (2 inches) was pressed firmly against the coated substrate. The tape was then removed at an angle of 180°, ie. pulled back on itself, in one rapid motion at a speed of about 2.5 centimeters (1 inch) per second.

The substrate was then evaluated, both visually and under a microscope at magnifications of up to 20X. The presence of adhesive on the substrate indicates a coating layer having good adhesion to the substrate and imparting good adhesion to a polymer. If at least 20% of the surface area of the substrate that was covered with the tape retains adhesive, the coating is considered to have passed the tape test. The coated copper C194 substrate passed the tape test.

The coated substrate was then evaluated for oxidation resistance by heating to 175° C., in air for 1.5 hours. No discoloration of the coated substrate was detected, indicating that the coating layer provided satisfactory oxidation resistance.

The electrolyte was then divided into three portions. One portion was kept silicon free. Sodium silicate was added to the other two portions at a level of 20 ppm silicon (Si:Zn ratio=1:50) in a first portion and 100 ppm silicon (Si:Zn ratio=1:10) in a second portion. After storage for 64 hours at room temperature with no current flowing through the electrolyte, the zinc content of each bath was determined. It should be recognized that the rate of zinc precipitation would be much more rapid at elevated temperatures such as when the electrolyte is operated at 60° C. The results are summarized in Table 1.

TABLE 1

| Silicon Content | Zinc Remaining after 64 Hours | Comments |
|---|---|---|
| -0- | 0.48 g/l | visible precipitate |
| 20 ppm | 0.88 g/l | visible precipitate |
| 100 ppm | 1.0 g/l | no visible precipitate |

After completion of the 64 hour storage period, copper alloy C194 substrates were electroplated in the silicon-free electrolyte and the 100 ppm silicon bath. Electroplating was again at 10 mA/cm$^2$ for 10 seconds with an electrolyte temperature of 60° C. The silicon-free bath had poor tape test results, indicative of a coating layer deposited from an electrolyte containing less than about 0.8 gm/l zinc.

Copper alloy C194 substrates plated in the 100 ppm silicon bath after completion of the 64 hour storage period showed no degradation in adhesion properties believed to be because the zinc content remained above the critical 0.8 gm/l level. These samples also showed no degradation in oxidation resistance when heated to 175° C. for 1½ hours.

It is apparent that there has been provided in accordance with this invention a zinc-containing aqueous solution that is resistant to precipitation that fully satisfies the objects, means and advantages set forth hereinbefore. While this invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A method for preparing an electrolyte for the deposition of a zinc containing anti-tarnish coating on a metallic substrate by inhibiting the precipitation of zinc from said electrolyte comprising the steps of:

a) supplying an aqueous medium having a pH in excess of 7;

b) dissolving in said aqueous medium silicon, from a water soluble silicon source, in an amount that provides a silicon ion content effective to inhibit precipitation of zinc from said electrolyte; and c) subsequent to said step (b) dissolving from a minimum of 0.8 gram per liter to about 30 grams per liter of zinc ions.

2. The method of claim 1 wherein the ratio, by weight, of silicon to zinc in said electrolyte is selected to be from about 1:5 to about 1:250.

3. The method of claim 2 wherein said water soluble silicon source is selected to be a silicate selected from the group consisting of sodium silicate, potassium silicate and mixtures thereof.

4. The method of claim 3 wherein said silicate is selected to be sodium silicate.

5. The method of claim 3 wherein in step (b) from about 0.01 to about 100 g/l of at least one water soluble metallic ion selected from the group consisting of chromium, copper, nickel, aluminum, tin, iron, and mixtures thereof is dissolved in said aqueous medium prior to dissolution of said zinc ions.

6. The method of claim 5 including selecting said at least one other water soluble metallic ion to be Cr(VI).

7. The method of claim 6 including selecting said Cr(VI) content to be from about 0.3 g/l to about 1 g/l and said zinc content to be from a minimum of 0.8 g/l to about 10 g/l.

* * * * *